United States Patent [19]

Vining et al.

[11] 4,417,528

[45] Nov. 29, 1983

[54] COAL GASIFICATION PROCESS AND APPARATUS

[75] Inventors: Paul H. Vining, Nashville; Jimmy B. Smith, Columbia, both of Tenn.

[73] Assignees: Mansfield Carbon Products Inc., Nashville, Tenn.; Peabody Development Company, St. Louis, Mo.

[21] Appl. No.: 427,442

[22] Filed: Sep. 29, 1982

[51] Int. Cl.[3] ..... F23G 5/00

[52] U.S. Cl. ..... 110/229; 48/77; 116/185

[58] Field of Search ..... 110/229, 230, 185, 341; 48/101, 77, 210

[56] References Cited

U.S. PATENT DOCUMENTS 4,308,034 12/1981 Hoang ..... 110/229 X

FOREIGN PATENT DOCUMENTS 2752609 8/1978 Fed. Rep. of Germany ..... 110/229

*Primary Examiner*—Edward G. Favors

*Attorney, Agent, or Firm*—Littlepage & Webner

[57] ABSTRACT

Coal devolatized and partially gasified in a travelling grate reactor is dropped into a shaft furnace to form a downwardly moving stack which moves then downwardly to and through a fixed bed gasifier, wherein it is burned to ash. A gas stream from the travelling grate reactor is down-drafted through the shaft furnace and a gas stream is up-drafted through the fixed bed gasifier, and the two streams combined are drawn through a heat exchanger and fed to a gas burner, combustion air for the gas burner being heated in the heat exchanger.

8 Claims, 1 Drawing Figure

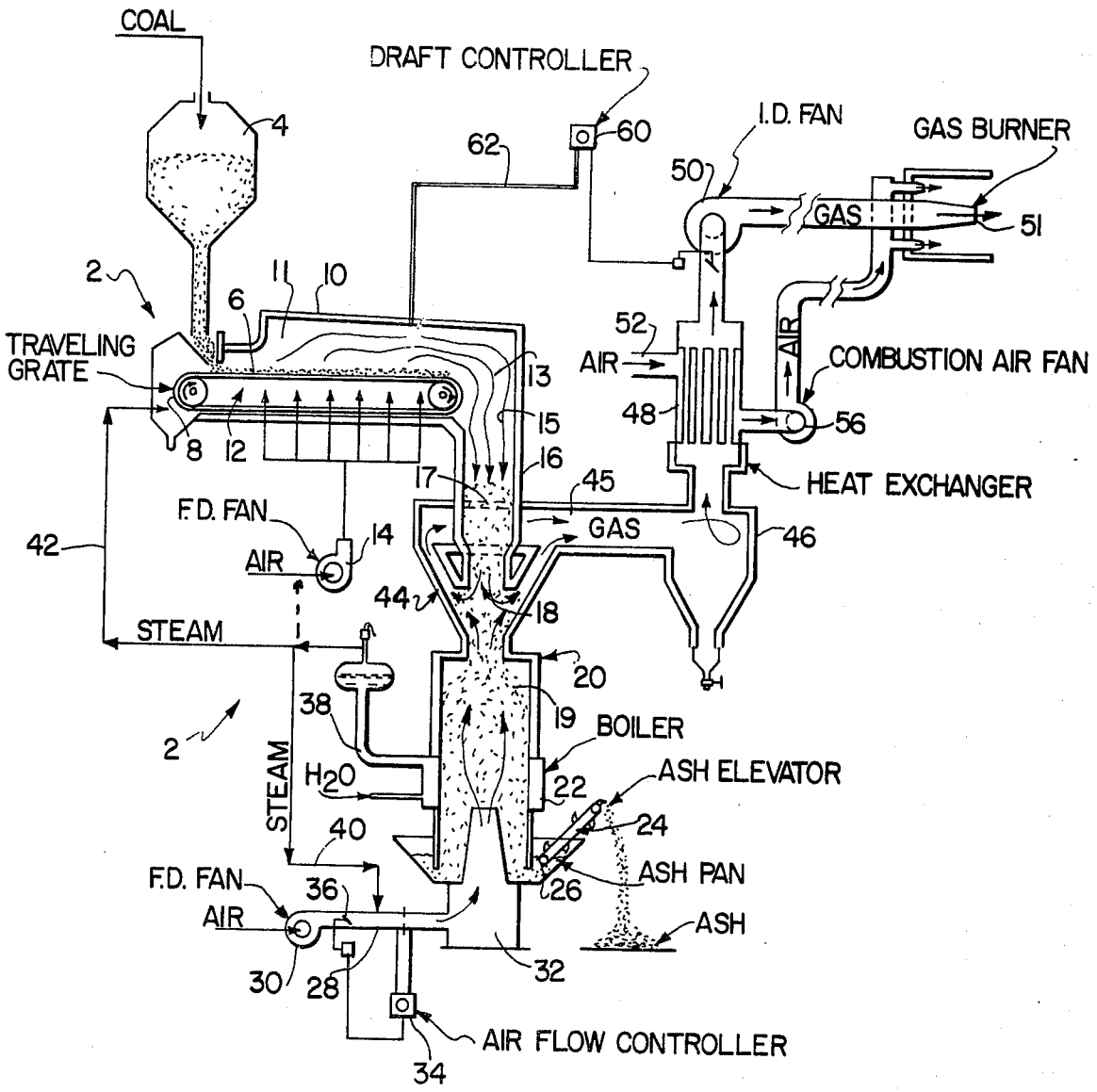
COAL
DRAFT CONTROLLER
I.D. FAN
GAS BURNER
GAS
TRAVELING GRATE
AIR
COMBUSTION AIR FAN
HEAT EXCHANGER
F.D. FAN
AIR
GAS
STEAM
BOILER
ASH ELEVATOR
ASH PAN
ASH
$H_2O$
F.D. FAN
AIR
AIR FLOW CONTROLLER

COAL GASIFICATION PROCESS AND APPARATUS

BACKGROUND OF THE INVENTION

Heretofore, the combination of a travelling grate reactor furnace, a shaft furnace and a fixed bed gasifier has been operated by feeding limited amounts of air and/or steam upwardly through a coal bed on the travelling grate so as to drive off most of the volatiles in the coal, almost all of the remainder of which volatiles were driven off by residual heat as the incandescent coal from the travelling grate reactor moved downwardly through the shaft furnace. The volatile-laden gases from the travelling grate reactor and shaft furnaces were exhausted from the top of the traveling grate reactor through a common flue and the product gas from the fixed bed gasifier was fed to a utilization device such as a boiler. This entailed certain problems in that care was needed to insure that air does not enter the shaft furnace, lest the fixed carbon in the partially gasified coal be burned there, rather than in the fixed bed gasifier. A lock hopper was interposed between the shaft furnace and the fixed bed gasifier and this needed expensive valves made of exotic materials. It also imposed certain limitations on the lump size of the hot carbon and, in addition, fine and coarse materials tended to segregate and this, in turn, upset the operation of the fixed bed gasifier, and plugging of the valves constantly interrupted the operation. Furthermore, as the hot incandescent carbon drops off the end of the travelling grate into the shaft furnace, a veritable inferno of hot flying particles is created, and when these were induced into the gas stream exhausted from the atmosphere of the travelling grate reactor furnace, particulate pollution resulted.

OBJECTS

The object of this invention is to provide a method and apparatus utilizing a first reactor, a shaft furnace which serves as a soaking pit and reactor for the material discharged from the first reactor, and a fixed bed gasifier in which the fixed carbons are gasified and product gas is created. In contrast with prior procedures, however, the volatile-laden gases from the first reactor are down-drafted through the hot carbon in the shaft furnace and drawn off, while a stream of product gas from the fixed bed gasifier is up-drafted. Both streams are combined and drawn through a heat exchanger and fed into a utilization device and reacted with the air which has been heated in the heat exchanger. One object here is to eliminate the need for an airlock or valves between the shaft furnace and the fixed bed gasifier.

A further object in down-drafting the gases from a first reactor through the bed of hot carbon in the shaft furnace is to react the $CO_2$ and $H_2O$ in the down-drafted gas to form CO and $H_2$, thus increasing the heating value from about 90 BTU/scf to approximately 130 to 140 BTU/scf. This gas can thus be combined with the gases from the fixed bed gasifier without reducing the latter's heating value.

A still further object is to create a reaction such as to cool the gases down-drafted through the shaft furnace and thereby make them easier to handle in subsequent stages. The reaction taking place in the down-drafted gases, i.e., $CO_2$ plus $C \rightarrow 2CO$ and $H_2O$ plus $C \rightarrow CO$ plus $H_2$ absorb heat, thus cooling the gases from about 2000° F. to about 1400° F.

Another object is utilizing the hot carbon in the shaft furnace as a filter for the particulate matter usually found in the gases exhausted from a travelling grate reactor and shaft furnace, these being deposited on the hot carbon in the shaft furnace.

These and other objects will be apparent from the sole FIGURE which is a diagram illustrating the process and apparatus.

Referring first to the FIGURE of the drawing, the gasification apparatus indicated generally at 2 starts with a hopper 4 into which coal is fed and which, in turn, feeds downwardly in the input end of the chamber 11 of a travelling grate reactor 10 to form a static bed 6 on the travelling grate 8. In this instance the travelling grate is a chain grate, the upper run of which passes over a zoned air box 12 into the zones of which air from a fan 14 and steam are fed in closely controlled amounts. Oxygen may be added if desired. In transit through the travelling grate reactor most of the volatiles are driven from the coal and the coal is partially gasified, and its temperature raised to about 2000° F. The hot incandescent carbon drops off the end of the travelling grate at the output end 13 of chamber 11 into the chamber 15 of a shaft furnace 16 and onto the top of a downwardly moving stack 17. The height of the stack is controlled by the rate of coal fed onto the travelling grate and the rate of ash taken off from the bottom of the fixed bed gasifier described hereinafter.

At the bottom of shaft furnace 16 is a throat outlet 18 through which the stack moves into the chamber 19 of a fixed bed gasifier 20 which is jacketed by a boiler 22. The material, at this point being essentially carbon and ash, is reacted and discharged as ash by an elevator 24 lifting out of water-sealed ash bin 26 at the bottom of the fixed bed gasifier. An air input conduit 28 supplied with air from a fan 30 leads into the lower portion of the material in the fixed bed gasifier via an air in-feed 32. The rate of air fed into the lower portion of the material in the fixed bed gasifier is controlled by an air feed controller 34 operating a damper 36 so that enough air is supplied to the material in the fixed bed gasifier to react with the carbon and reduce it to ash. Part of the steam derived from boiler jacket 22 via steam outlet 38 is fed via line 40 into the air input to the material in the lower portion of the fixed bed gasifier, and additional steam derived from the steam outlet is fed via a line 42 back into the travelling grate reactor 10 or into the undergrate air.

Heretofore, in a system incorporating the features described above, a flue in the roof of the travelling grate reactor provided a gas takeoff for the gaseous by-products of the reactions in the reactor furnace and the shaft furnace, and a gas takeoff was provided for the product gas from the fixed bed gasifier. The gases from the shaft furnace ascended to the atmosphere of the travelling grate reactor and were exhausted with the gases therefrom through the common flue in the roof of the shaft furnace. With this invention, however, a gas takeoff 44 common to the throat 19 at the lower end of the shaft furnace had a throat 47 at the upper end of the fixed bed gasifier leads to a common takeoff 45, through which both gas streams are drawn. Thus, the gases from the travelling grate reactor are down-drafted through the material in the shaft furnace and the gases from the fixed bed gasifier are up-drafted and combined therewith, both streams of gases, after passing through a cyclone separater, 46, are drawn through a heat exchanger 48 by a fan 50 and fed to the gas burners 51. Air from an inlet 52 is drawn through heat exchanger 48 by a fan 56 and fed as at 58 to the gas burner 51.

The down-draft through the material in the shaft furnace is controlled by a draft controller 60 which has a pressure-sensing line 62 leading into the chamber of the travelling grate reactor and which, in turn, controls a damper 64 between the heat exchanger 48 and fan 50. Thus the draft through the gas take-off is controlled by the gas pressure prevailing in the travelling grate reactor chamber 11 and should be such as to maintain the pressure in the reactor chamber at or near atmospheric pressue.

In operation, the volatile-rich gases which are driven from the material in the bed 6 in the travelling grate reactor 10 are down-drafted through the hot incandescent stack of carbon which moves downwardly through shaft furnace 16 wherein the $CO_2$ and the $H_2O$ in the gas react to form CO and $H_2$ thus increasing the gas heating value from about 90 BTU/scf to approximately 130 to 140 BTU/scf. This matches the gas from the fixed bed gasifier so that the two gases can be combined without reducing the heating value of the gases from the fixed bed gasifier. The stack of material in the shaft furnace serves as a filter to collect the dust usually found in the gas from the flue in the travelling grate reactor.

The reactions which take place when the gases from the travelling grate reactor are pulled down through the hot carbon in the shaft furnace are endothermic, i.e., the reactions $CO_2$ plus C→2CO and $H_2O$ plus C→CO plus H2 absorb heat, thus cooling the gases from about 2000° F. to about 1400° F. This system, being valveless, is not subject to plugging and material transfer problems which heretofore have occurred in systems of this general type. With a valve system, the size of char or coke is dictated by the valve size, i.e., one cannot produce carbon which is larger than the valve opening. Elimination of the valve system also eliminates this operating restriction.

The combination of the gas which is produced in the fixed bed gasifier will depend on the raw coal feed and conditions in the first stage. In general, however, when air and steam (no $O_2$ enrichment) are used the basic gas components (on a wet basis) will be:

| Range % | |
|---|---|
| 15-30 CO | 2-9 $H_2O$ |
| 3-10 $CO_2$ | 0-2 $H_2S$ |
| 45-55 $N_2$ | |
| 5-15 $H_2$ | HHV = 130 Btu/Scf |

The major reactions which take place in the fixed bed gasifier are as follows:

| | Zone |
|---|---|
| #1 $C + O_2 \rightarrow CO_2$ | Oxidation |
| #2 $CO_2 + C \rightarrow 2CO$ | Reduction |
| #3 $H_2O + C \rightarrow H_2 + CO$ | Reduction |
| Hot Carbon | |
| Flow of Materials | |
| Reduction | |
| | Fixed Bed Gasifier |
| Oxidation | |
| Ash | |

-continued

| | Zone |
|---|---|
| Air + Steam | |

Very little methane (<0.5%) is formed.

The major reactions which take place in the shaft furnace are #2 and #3 above. Reaction #1 takes place to a limited extent since the $O_2$ level in the stoker gases is low.

While the invention has been described in connection with a travelling grate reactor, it is useable with reactors other than of the travelling grate type.

I claim:

1. In combination a traveling grate reactor having a chamber with input and output ends, means for feeding coal into the input end, means for moving said coal from the input end to the output end, means for feeding gases selected from the group comprised of air, oxygen and steam into the reactor chamber, a shaft furnace having a chamber with upper and lower ends, the lower end disposed below the output end of the reactor chamber for receiving coal gravity discharged therefrom, means for receiving coal discharged from the lower end of the shaft furnace chamber, and gas take-off means connected to the lower end of the shaft furnace chamber, said gas take-off means including gas drafting means for down drafting gas from the traveling grate reactor chamber through the coal in said shaft furnace chamber and into the gas take-off means.

2. In the combination claimed in claim 1, means for sensing gas pressure prevailing in said reactor chamber, and means for controlling said gas drafting means in accordance with the gas pressure prevailing in said traveling grate reactor chamber.

3. In combination, a traveling grate reactor having a chamber with laterally spaced input and output ends, means for feeding coal into the input end, means for moving said coal in static bed form from the input end to the output end, means for feeding gases selected from the group comprised of air, oxygen and steam into the traveling grate reactor chamber, a shaft furnace having a chamber with upper and lower ends, the upper end disposed below the output end of the traveling grate reactor chamber for receiving coal gravity discharged therefrom, a fixed bed gasifier having a chamber with an upper end connected to and disposed below the lower end of the shaft furnace chamber for receiving coal gravity discharged therefrom, said fixed bed gasifier chamber having exhaust means and ash discharge means, and gas take-off means connected to the lower end of the shaft furnace chamber, said gas take-off means including gas drafting means for down drafting gases from the traveling grate reactor chamber through the coal in said shaft furnace chamber and into the gas take-off means.

4. The combination claimed in claim 3, said gas take-off means having a connection with the gas exhaust means of the fixed bed gasifier chamber whereby to draw both the gases down drafted through the coal in the shaft furnace chamber and the gases derived from the fixed bed gasifier chamber in a common stream.

5. The combination claimed in claim 4, means for sensing gas pressure prevailing in said traveling grate reactor chamber, and means for controlling said gas drafting means in accordance with the gas pressure prevailing in said traveling grate reactor chamber.

6. A method for producing coke and gas which comprises;

passing coal through a chamber of a traveling grate reactor while reacting the same with gases selected from the group comprised of oxygen, air and steam until at least most of the volatile matter is driven therefrom in gaseous form comprised essentially of $CO_2$ and $H_2O$ and the coal is reduced essentially of hot fixed carbon and ash, forming a downwardly moving stack of said reduced coal in the chamber of the shaft furnace having an upper end connected to the chamber of the traveling grate reactor, increasing the heating value of the gases produced in the traveling grate reactor chamber and cooling the same by down drafting the same through the reduced coal in the downwardly moving stack in the shaft furnace chamber while reacting the same to form essentially CO and $H_2$, exhausting the down-drafted gases from the shaft furnace chamber, and discharging the reduced coal from the lower end of the shaft furnace.

7. The method claimed in claim 6, wherein the coal discharged from the lower end of the shaft furnace is reacted with air and steam in the chamber of a fixed bed gasifier to form essentially CO and $H_2$ and ash, discharging the ash from the fixed bed gasifier chamber, and exhausting the gases from the fixed bed gasifier chamber together with the down drafted gases from the shaft furnace chamber.

8. The method claimed in claim 7, including the steps of;

sensing the gas pressure prevailing in the chamber of the traveling grate reactor, and controlling the rate of exhaustion of gases from the shaft furnace and fixed bed reactor chambers in accordance with the gas pressures sensed in the traveling grate reactor chamber.

* * * * *

UNITED STATES PATENT AND TRADEMARK OFFICE

CERTIFICATE OF CORRECTION

PATENT NO. : 4,417,528

DATED : November 29, 1983

INVENTOR(S) : Paul H. Vining et al

It is certified that error appears in the above-identified patent and that said Letters Patent is hereby corrected as shown below:

Column 2, line 41
Delete "feed", insert --flow--.

Column 2, line 61
Delete "19", insert --18--.

Column 2, line 62
Delete "had", insert --and--.
Delete "47".

Column 3, line 4
Delete "as at 58".

Column 3, line 9
Delete "64".

Column 3, line 43
Delete "combination", insert --composition--.

UNITED STATES PATENT AND TRADEMARK OFFICE

CERTIFICATE OF CORRECTION

PATENT NO. : 4,417,528 Page 2 of 2

DATED : November 29, 1983

INVENTOR(S) : Paul H. Vining et al

It is certified that error appears in the above-identified patent and that said Letters Patent is hereby corrected as shown below:

Column 3, line 64 to Column 4, line 5

Delete these lines of the table, insert --

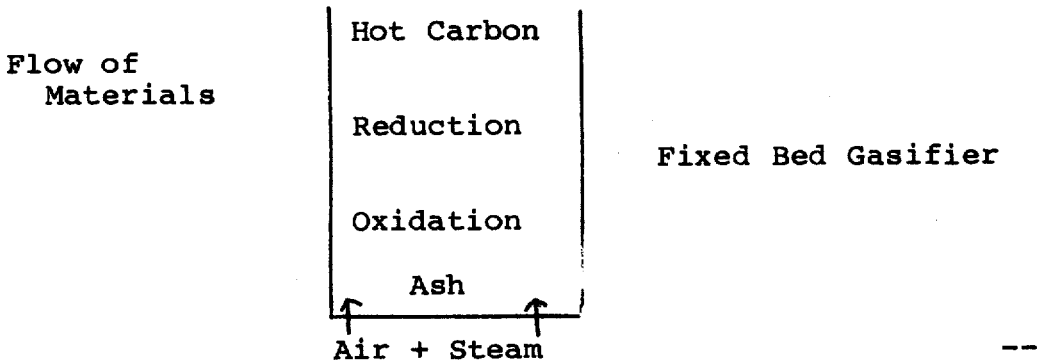

--

Signed and Sealed this

Twenty-first Day of February 1984

[SEAL]

*Attest:*

GERALD J. MOSSINGHOFF

*Attesting Officer*

*Commissioner of Patents and Trademarks*